United States Patent [19]

Augustine

[11] 4,141,192

[45] Feb. 27, 1979

[54] DOOR BRACE FOR FACILITATING HANGING

[76] Inventor: Pius Augustine, 5945 W. Mississippi, Denver, Colo. 80226

[21] Appl. No.: 890,059

[22] Filed: Mar. 27, 1978

[51] Int. Cl.[2] ..... G01B 3/14; E04F 21/00

[52] U.S. Cl. ..... 52/749; 33/194; 52/127; 52/173 R; 52/217; 144/309 N; 269/321 F

[58] Field of Search ..... 52/749, 122, 127, 173, 52/215, 217, DIG. 1; 49/507; 144/144.5 R, 55, 288, 309 N; 33/194, 197; 269/321 F

[56] References Cited

U.S. PATENT DOCUMENTS

| | | | |
|---|---|---|---|
| 1,630,429 | 5/1927 | Hobbisiefken | 33/194 |
| 2,949,948 | 8/1960 | Zern | 144/309 |
| 3,458,056 | 7/1969 | Stefan et al. | 269/55 |
| 3,807,720 | 4/1974 | Converse et al. | 269/321 F |
| 3,834,034 | 9/1974 | Berquist | 33/194 |
| 3,861,662 | 1/1975 | Morse | 269/321 F X |

*Primary Examiner*—J. Karl Bell
*Attorney, Agent, or Firm*—Richard D. Law

[57] ABSTRACT

An L-shaped channel, for mounting on the lower outside corner of a door, and an adjustable lateral floor brace, for holding an unhinged door upright.

4 Claims, 3 Drawing Figures

DOOR BRACE FOR FACILITATING HANGING

This invention relates to a brace for supporting an unhinged door in proper location and in upright position for hinging the door to a door jamb. The unit is adjustable to permit easily hanging of the door.

The art of hanging doors on a door jamb with hinges and locks is a precise art of carpentering, particular since tolerances are quite close for a smooth opening and closing a door. Most carpenters use two people to set doors in the door jambs, which permits one worker to hold the door while the other marks the door for hinges or locks. After mounting the hinges halves on the door and the jamb, the door is hung by mating the hinges for inserting the pintel. Since the door can not rest on the floor, the marking and hanging requires considerable manipulation of the door in relation to the jamb. As a one worker job, for example, do-it-yourselfers, it is lengthy, difficult and can be quite annoying.

SUMMARY OF THE INVENTION

The device of the invention is a channel with general L-shape, with the longer leg arranged for vertical position and the shorter leg for horizontal position on the edge of an upright door. The channel is of a width to fit over the edge of a door. The unit is arranged to be positioned on the lower outside corner of the door, with the inside surfaces of the channel portions flush with the edges of the door. The corner of the L-shaped member is provided with an attached lateral member extending in both directions for supporting the L-shaped member in upright position. A jackscrew at the two outer ends of the lateral permit height adjustment of the corner of the held door.

OBJECTS OF THE INVENTION

Included among the objects and advantages of the invention is to provide a simple, easily used door brace for facilitating hanging doors.

Another object of the invention is to provide a door brace arranged to support an upright to permit one man operation of hanging a door on a building, including holding such a door for marking and attaching a door to a door jamb.

Still another object of the invention is to provide an adjustable door brace for a door arranged for easy height adjustment of an unhinged door in its door jamb.

Yet another object of the invention is to provide an easily used brace for a door, for holding a door in upright position during preparation and setting a door on its hinges in a door jamb.

These and other objects and advantages of the invention may be ascertained by reference to the following description and appended drawings.

GENERAL DESCRIPTION OF THE DRAWINGS

SPECIFIC DESCRIPTION OF THE DRAWINGS

Figures 1, 2, 3:
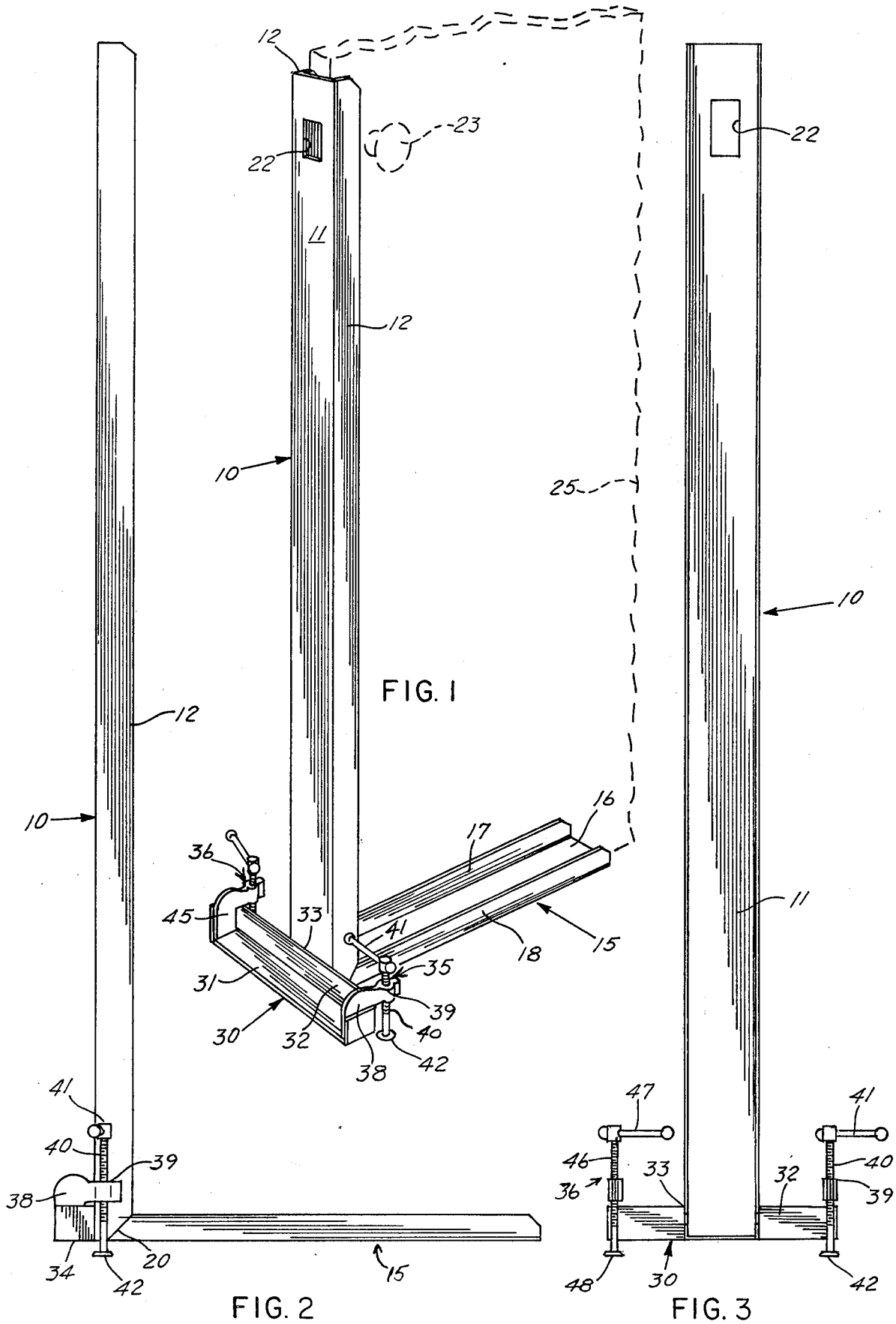
FIG. 1 is a perspective view of the door brace, according to the invention, showing its mounted position on an upright door (indicated position).
FIG. 2 is a side elevational view of the door brace of FIG. 1.
FIG. 3 is an end elevational view of the door brace of the invention.

The embodiment shown in FIGS. 1-3 illustrate a particular form of the invention, produced of readily available construction shapes of steel. The unit includes an upright channel member 10, is U-shaped, having a web 11 and legs 12 and 13. Welded or otherwise secured at right angle to the upright 10 is a second U-shaped channel member 15, which has a web 16 and legs 17 and 18. The channels are preferably welded along weldment line 20 which follows the web edges between the two members and includes a 45° intersection cut of the adjacent legs. A rectangular opening 22 is cut through the web 11 of the upright in the exact position of the latch plate or a door lock, so that the door and jamb may be marked for the drilling and inletting of the lockset on the door and latch plate on the jamb. A latch bore is arranged to intercept a lateral bore in the door for the remainder of the lockset and a doorknob 23 (shown in phantom). A door 25, shown partially by phantom lines, indicates the seating of a door by its outside lower corner into the L-shaped channel member formed by channels 10 and 15. By having the channel member at 90°, the webs of the channels generally contact face to face with the adjacent edges of the door.

The L-shaped member is supported in its upright position by means of an angle 30 having a lower leg 31 and a 90° leg 32. The angle 30 is welded onto the L-shaped member along an upper weldment 33 (along the top of the leg 32) to the web 11 of the channel 10, and by a weldment 34 at the intersections of the angle legs to the L-shaped member.

The lateral brace 30 is arranged for adjustment by means of jackscrew 35 at one end and a jackscrew 36 at the opposite end. Each jackscrew includes a brace member welded to the angle 30, a threaded opening through the brace, and a screw member threadedly engaged in the thread opening. The jackscrew 35 includes a brace member 38, a threaded opening 39 through an outer portion of the brace 38, and a screw member 40 threadedly engaged in the threaded opening. The jackscrew 40 has a handle member 41 for manipulation, and a foot member 42 for resting on the floor. The jackscrew 36 (FIG. 3) includes a similar arrangement including the angle brace member 45, screw 46, handle 47 and a foot 48. The brace members 38 and 45 are welded to the angle 30, and may be supported by braces as may be necessary.

The device is used by placing the L-shaped member in position to hold a door upright and adjacent the door jamb. A door is placed with the lower outside corner in the L-shaped member, that is, the lower corner opposite the hinges. The door is pushed into position next to the hinge jamb. The hinge edge of the door is then blocked to the height desired and a front edge of the door is raised or lowered by means of the jackscrews so that the hinge edge of the door is in exact alignment with the door jamb. The hinge position marks are then placed on both the door and the door jamb. The door may then be removed for installing the hinges halves in the door and the jamb. After the hinge halves are mounted on the doors and the door jambs, the door may then be moved into position against the door jamb. With the hinge pivot members in alignment, the hinge pintels may then be placed in the hinges. The door brace may then be used to mark a lock opening through the hole 22, and then moved against the jamb opposite the hinge jamb for marking the latch plate position. The door brace may then be removed, and the necessary cuts and countersinks made for the lockset and latch plate.

It is thus seen that a single worker may utilize the door brace of the invention for holding and supporting the door in proper position during the marking and the actual setting of the door on its hinges, including the marking of the lockset in the door and in the lock jamb. The unit is rugged and securely holds the door in its upright position for the manipulations necessary for the setting of the door.

What is claimed is:

1. A door brace for facilitating hanging a door, comprising:

(a) an L-shaped member comprising a first channel member rigidly secured to a second channel member at 90° with the channels secured with their opening on the same side to permit the channels to encompass both edges of a 90° corner of a door;

(b) a lateral member secured to said L-shaped member adjacent the intersection of said first and second channel members, extending outwardly from said L-shaped member providing lateral support for said L-shaped member in generally upright position, and;

(c) height adjustment means at the outer ends of said lateral member, and including means for individually raising and lowering the outer ends of said lateral member.

2. A door brace according to claim 1, wherein said first channel member is arranged to be upright against a door edge, and is substantially longer than said second channel member.

3. A door brace according to claim 1, wherein said lateral member is an angle iron.

4. A door brace according to claim 1, wherein said adjustment means includes a jackscrew at each end of said lateral member, inclusive of handle means for manipulation and floor contacting foot means.

* * * * *